US006059583A

United States Patent [19]

Croft et al.

[11] Patent Number: 6,059,583

[45] Date of Patent: May 9, 2000

[54] INTERCONNECTION BETWEEN MEDIA CONNECTORS OF UNKNOWN INTERFACE STANDARDS AND A COMPUTER COMMUNICATIONS CARD

[75] Inventors: Kenneth A. Croft, Salt Lake City; Stephen J. Parker, Centerville, both of Utah

[73] Assignee: 3 COM Corporation, Santa Clara, Calif.

[21] Appl. No.: 09/086,143

[22] Filed: May 28, 1998

[51] Int. Cl.[7] ..... H01R 13/44

[52] U.S. Cl. ..... 439/131; 439/955

[58] Field of Search ..... 439/489, 955; 361/64, 107

[56] References Cited

U.S. PATENT DOCUMENTS 4,876,712 10/1989 Brint et al. ..... 439/955

4,979,205 12/1990 Haraguchi et al. ..... 439/955

*Primary Examiner*—Renee S. Luebke
*Assistant Examiner*—T C Patel
*Attorney, Agent, or Firm*—Workman, Nydegger & Seeley

[57] ABSTRACT

An improved electrical connection system for use in a communications card for interfacing a media connector of an unknown media with a computer is provided. In a preferred embodiment, the connection system facilitates the physical coupling of either an RJ-11 jack or an RJ-45 jack of the media connector into the same retractable jack of a PCMCIA card. Upon the physical coupling of the media connector, the connection system of the present invention evaluates the signal characteristics to determine which type from among a group of supported media types is coupled through the media connector. The connection system of the communications card conforms to the media standard and supports that standard through any communications transpiring therebetween. Typical media standards supported by the preferred embodiment of the present invention include PSTN, ISDN, Ethernet and wireless transceivers.

14 Claims, 4 Drawing Sheets

INTERCONNECTION BETWEEN MEDIA CONNECTORS OF UNKNOWN INTERFACE STANDARDS AND A COMPUTER COMMUNICATIONS CARD

BACKGROUND OF THE INVENTION

1. The Field of the Invention

The present invention relates generally to the interface between physical/electrical media connectors and a communications card in a computer system. More specifically the present invention relates to an improvement in automatically configuring an electrical connection therebetween.

2. The Relevant Technology

The field of transmission of data by phone lines or network cables is a rapidly expanding field. Users of personal computers in particular are finding such practice to be of great value. For example, there are numerous public and private networks and databases which store data or programs. Absent the ability to send and receive data over telephone lines through a modem, a user is relegated to relying upon the exchange of discs or tapes in order to receive data suitable for use with their computer.

Similarly, companies performing tasks that are integrated are aided by local area networks ("LANs") which permit personnel to exchange electronically retrievable data. The ability to freely transfer data and information from one computer to another computer over a telephone or network line may dramatically increase productivity and reduce overall production time.

To translate the binary code utilized by a computer into signals capable of being transmitted over the telephone or network lines, modems have been developed to translate and reconfigure binary signals into analog signals capable of propagation over telephone or network lines. For conversion of signals to take place, a modem must be placed between the computer generating the binary signals and the communication line capable of carrying the analog signals.

Typically, in today's practice, a modem at the transmitting computer end of a communication line receives binary digital data from the computer and converts the binary code received from the computer into modem frequency signals. These modem frequency signals are then transmitted over the communication lines to a receiving modem at the receiving computer.

The modem at the recipient's end then converts the modem frequency signal back to binary digital data characters and inputs the data characters to the input port of the receiving computer.

As today's modems serve to provide a compatible interface between the communication lines and the computer, the Federal Communications Commission ("FCC") and telephone companies require an interface to moderate all signals or energy being input into the phone lines. This interface protects the phone lines and systems from damage, thereby ensuring the integrity and quality of transmissions over the phone lines.

A required part of this interface is a Data Access Arrangement ("DAA") circuit. The DAA circuit provides an impedance match and also serves to isolate the modem and the computer from transient signals and other disturbances coming in over the phone line. The DAA also protects the phone line from disabling influences emanating from the computer or the modem.

For example, damage would occur to the telephone system if instead of transmitting frequency signals, DC power was transmitted over the phone lines. Because the modem is attached directly to the phone line, the modem must incorporate the required FCC interface and must comply with any requirements imposed by local telephone companies.

The ubiquity of the telephone and the need for interactive systems throughout the world have caused standards to be established for the components of a telephonic system. Standardization allows telephone systems and devices using those systems to be interchangeable. The components of the telephone that are most thoroughly standardized are physical/electrical media connectors. Likewise, computer networks have also become commonplace and also utilize standard media connectors.

Physical/electrical media connectors are used by almost all telephone and communication companies throughout the world for many applications, the most important of which are interconnection of telephones with telephone lines and networks with network lines. For this reason, stringent standardization of connectors is required if compatibility and interactivity is to be realized.

One popular physical/electrical media connector used in the United States of America is the RJ-11 4-position miniature modular plug physical/electrical media connector. The RJ-11 is used between the telephone line and the telephone itself. Another important standard is the RJ-45 8-position miniature modular plug physical/electrical media connector. The RJ-45 is used primarily for network connectivity (e.g., Ethernet) and higher data rate technologies such as Integrated Services Digital Network (ISDN) or wireless technologies (e.g., cellular or PCS).

In contradistinction to the development of telephone lines, transmission or communication lines used in LANs have been developed specifically for the transmission of computer generated signals. Because of the recent development of these transmission lines, a variety of internal configurations for transmission lines have been developed to accomplish the transmission of computer data between computers.

A typical local area network comprises several computers at remote locations throughout a building interconnected with twisted pair cable utilizing RJ-type physical/electrical media connectors. The network is typically connected to a file server. A file server is a computer providing shared access to a file system, printer, electronic mail service, or modem. The file server is a combination of hardware and software that contains files shared by everyone connected to the LAN.

As LANs utilizing twisted pair cable are capable of transmitting signals at a higher rate than signals traveling through telephone lines, the requirements of the devices used to translate and reconfigure signals from the computer for transmission through lines have consequently been developed with different requirements.

The counterpart to the modem in telephonic communications is the LAN adapter card or data communications card. In a similar fashion to a modem, these communications cards reconfigure the parallel data produced by the computer into a serial form and back. These cards also provide buffering, encoding and decoding, cable access, and transmission.

As the use of LANs increases, it has become increasingly more beneficial for users of portable computers to have the ability to interact with several local area networks at different locations. For example, information at one location may be downloaded to a portable computer that allows a user to manipulate the data during a business trip and load the manipulated data onto the network at a destination. Diagnostics and maintenance are also made easier through the use of common connectors.

As the popularity of twisted-pair cable has increased, the popularity of the most frequently used physical/electrical media connector, the RJ-45 8-pin miniature modular plug, has also increased. This increase in popularity of the 8-pin miniature modular plug has introduced the same problems and solutions into LANs as will be discussed regarding the RJ-11 physical/electrical media connector in the development of modems.

Many modems in use today are configured as external accessory units, housed in their own cases, and attached to the computer. Typically, external modems are electrically connected to the telephone with a telephone extension line utilizing physical/electrical media connectors at each end. External modems are often employed by users of personal computers because they can easily contain a substantial amount of electronic circuitry or hardware, as well as executable programs or software.

With the advent of downsizing technology in computer components, however, smaller portable computers (often referred to as laptop or notebook computers) have taken the place of many of the desktop models which use external modems. With the new-found portability available with laptop or notebook computers, the size of external modems has proved cumbersome and been rendered obsolete in keeping with the portability that buyers of these downsized computers desire.

To overcome the inconvenience and physical limitations of external modems, smaller modems have been developed that are small enough to be built integrally within the housing of a portable computer. As a result, integral internal modems that interface with the ubiquitous RJ-11 and RJ-45 system provides users of portable computers with internal modems having a uniform standard interface for media access devices such as modems. Now, modem manufacturers can build products capable of accepting the RJ-11 and RJ-45 media connectors with confidence that their product can be used in a wide geographical area. Because modems can be built to the RJ-11 and RJ-45 uniform standards, consumers benefit from the ability to interchange and interconnect media access devices without the need for adapters for products made by different manufacturers.

As computer housings have continued to be downsized, internal spatial restrictions have required the establishment of standards for the internal accessories of the computer. One set of standards applicable to memory cards has been developed by the Personal Computer Memory Card International Association (PCMCIA). This organization is comprised of hundreds of manufacturers of memory cards and related peripheral equipment. By convention, the PCMCIA has determined that the spatial standard for all memory cards used in down-sized computers should be restricted to a rectangular space approximately 55 mm in width, 85 mm in length, and 5 mm in depth.

In keeping with the PCMCIA standards for memory cards, internal modem and network card manufacturers have adopted the same spatial standards for use with their downsized communications cards. By complying with the standards established by PCMCIA for memory cards, communications card manufacturers have assured themselves of compatibility and spatial conformity with computers utilizing the new PCMCIA standards.

The constraints imposed by this new PCMCIA standard have resulted in the development of "credit card" communications cards. Most of the components formerly housed within a modem are now contained within a credit card-sized device. Although many of the communication cards serve the functions of a modem, a similar card has been contemplated for use in LANs. Nonetheless, the problem will hereinafter be addressed in terms of the PCMCIA standard communications card.

Since the depth of a PCMCIA standard communications card is limited to 5 mm and the depth of a typical media connector, such as the RJ-11 and RJ-45 type miniature modular plug, is approximately 8–12 mm, the typical media connector exceeds the depth restrictions imposed by the PCMCIA standards for internal computer components.

While many prior art devices have tried to solve the depth incompatibility problem between the PCMCIA standard communications card and the media connector, a "pop-out" or sliding interface device has emerged as a popular solution. The pop-out interface device, known commonly as the XJACK® initially produced by MEGAHERTZ Corp., now owned by 3 Com Corp., solves many of the interface problems posed by prior art devices. Such solved problems include, but are not limited to: (i) the elimination of carrying along an extra interfacing device compatible with both the media connector and the PCMCIA communications card; (ii) the elimination of ensuring a DAA in the interfacing device is compatible with the computer; (iii) the elimination of physical interference between adjacent PCMCIA communication cards in adjacent slots when the PCMCIA communication card has an enlarged portion thereof larger than the conventional 5 mm thickness; (iv) the elimination of potential breakage of the interface connector when not in use; and (v) the elimination of protrusions beyond the normal dimensions of the computer so that the computer portfolio is more compatible with devices typically transporting laptop computers.

With reference to FIG. 1, a typical embodiment of a sliding interface device in the form of a conventional 5 mm thick PCMCIA-architecture style communications card for directly interfacing with a media connector is depicted generally as 20. The communications card 29 defining the interface device 20 has a retractable access portion 22 and a fixed portion 24.

The fixed portion 24 is in electrical communication with a computer (not shown) by means of electronic circuitry connected on a printed circuit board (PCB) housed internally within the communications card 29. For brevity, fixed portion 24 may sometimes be referred to as the PCB 24 although the fixed portion includes more than just the PCB and electronic circuitry. The retractable access portion 22 is in electrical communication with the fixed portion 24 through a flexible printed circuit board 30. During use, in means well known in the art, the retractable access portion 22 slides in and out of a slot 32 formed within the PCB 24. The retractable access portion 22 is urged out of the slot 32 by a spring 34 biased, in a direction external to the computer housing, by a ledge 36 connected to the PCB 24. Although not shown, the computer housing during use is substantially parallel to an edge 37 of the communications card 29. A limiting notch 42 engaged by a biased lever 40 is used to restrict the travel distance of the interface device to a predetermined distance when the retractable access portion is urged in a direction external to the computer housing by the spring 34. After use, a retention notch 38 in combination with the biased lever 40 is used to retain the retractable access portion 22 within the housing of the computer.

An aperture 44 having a plurality of walls 46 is formed within the retractable access portion 22. The aperture 44 is so sized and shaped as to be capable of receiving a physical/electrical media connector. Formed within aperture 44 by means of walls 46 is a broad retention clip groove 48, a narrow retention clip groove is 50, and a retention ridge 52. These structures within aperture 44 provide for the retention of a connector pin block of a physical/electrical media connector. A guide track 54 is formed within communications card 29 protruding upwardly from the bottom of communications card 29. Guide track 54 is interengaged with a corresponding guide groove formed in the bottom of retractable access portion 22.

When a user desires to connect a telephone line to the communications card, biased lever 40 is manipulated out of retention notch 38. As retractable access portion 22 is released from the grip of biased lever 40, tension applied by spring 34 urges retractable access portion 22 out of slot 32. The progress of retractable access portion 22 is guided by guide track 54 and is halted when biased lever 40 engages limiting notch 42. A user then inserts a physical/electrical media connector into aperture 44 to provide an electrical connection between communications card 29 and the telephone line. When a user no longer desires to access the retractable access portion 22, the user merely presses retractable access portion 22 back within the confines of the computer housing until the retention notch 38 is engaged by biased lever 40.

Although extremely effective as a device suitable for physically and electrically interconnecting a media connector with a PCMCIA communications card, the commonality of the RJ-11 and RJ-45 interfaces for a plurality of electrically divergent and incompatible standards presents a substantial problem to a user in determining if the electrical interface presented to the common RJ-11 or RJ-45 physical interface is compatible with the presented media connector. For example, while the RJ-11 physical interface standard generally coincides with a Public Switched Telephone Network (PSTN) electrical interface standard, the RJ-45 physical interface standard is compatible with a myriad of electrical interfaces including LAN (e.g., Ethernet), Integrated Digital Services Network (ISDN), Universal Serial Bus (USB) and wireless communication devices such as cellular and other wireless data standards.

While the physical interfaces are compatible across these various standards, the incorrect coupling of the electrical interface standards can result in substantial damage to the interfacing components of either the media connector host or the communications card circuitry. While such a likelihood of incorrect interfacing would not have been as probable in the past since, for example, ISDN has only become commonplace in the recent few years, presently, communications systems increasingly are supporting multiple communications electrical standards over legacy hardware. For example, ISDN may be implemented using twisted pair cable paths once providing a PSTN service. Additionally, many homes and offices have various communication services co-located that present divergent electrical interfaces.

Accordingly, it would be an advance to provide an improved and flexible electrical interface between the media connector and the traditional processing portions of the communications card. Furthermore, it would be an additional improvement to provide a physical and electrical interface that is both compatible with the RJ-11 and RJ-45 physical interfaces and associated electrical interfaces.

SUMMARY AND OBJECTS OF THE INVENTION

It is, therefore, an object of the present invention to provide an improved electrical connection that may determine which type of media, from among a plurality of media, is being interfaced through a media connector to a communications card having a retractable portion.

It is another object of the present invention to provide an improved electrical connection that upon determination of a type of media coupled through said media connector to said communications card, the communications card operably and compatibly configures itself for interacting with said media using the discerned media standard.

It is a further object of the present invention to provide an improved electrical connection that is compatible for media standards having varied physical interfaces such as RJ-11 and RJ-45.

In accordance with the invention as embodied and broadly described herein, the foregoing and other objectives are achieved by providing a communications card for use in interfacing between a media connector capable of being coupled to a media connector of an unknown media and a downsized computer. In the preferred embodiment, the communications card is comprised of two portions, a retractable access portion and a fixed portion. The retractable access portion has an aperture formed therein configured to receive the media connector. A conductive flexible printed circuit board having a first and a second end mates with both the retractable access portion and the fixed portion to facilitate the electrical conduction between the electrical contacts of the media connector and the electronics resident on the fixed portion of the communications card. The first end makes electrical contact with the media connector while, simultaneously, the second end makes electrical contact with the fixed portion.

The retractable portion of the communications card is physically able to receive both RJ-11 and RJ-45 media connectors into the same aperture. The fixed portion of the communications card has resident thereon sensing circuitry to both determine which one of a plurality of media supported by the communications card is represented by said media connector when coupled with the communications card, These and other objects and features of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which.

DETAILED DESCRIPTION OF THE PREFERRED EMBODIMENTS

In accordance with the present invention, an improved electrical connection is provided for enabling the coupling of a media connector presenting one from among several different interface standards to a common communications card. The communications card is capable of both receiving differing physical standards such as an RJ-11 or an RJ-45 media connector as well as receiving differing electrical interface standards such as PSTN, Ethernet, ISDN and wireless standards. It is a feature of the present invention to compatibly and operably accommodate these varying standards through the use of a single retractable physical interface as well as through the use of an electrical sensing circuit capable of determining the interface standard presented and configuring the communications card accordingly to interact with the determined media or interface standard.

As used herein, a "PCMCIA communications card" or "communications card" refers to a communications card falling within the memory card parameters defined by the Personal Computer Memory Card International Association having a thickness less than the thickness of a miniature modular jack physical/electrical media connector. Accordingly, a communications card also refers to PCMCIA architecture modem cards, PCMCIA architecture network cards, such as a LAN, or equivalents thereof.

As used herein, a "miniature modular jack physical/electrical media connector" or "media connector" connotes a media connector such as those connectors having physical attributes described in F.C.C. parts 15 and 68, expressly incorporated herein by reference. Specific media connectors such as a RJ-11 or a RJ-45 are merely references to a specific exemplary media connector falling within the broader parameters of the term "media connector" and should not be used to limit the scope of the present invention to specific connectors.

Figure 1:
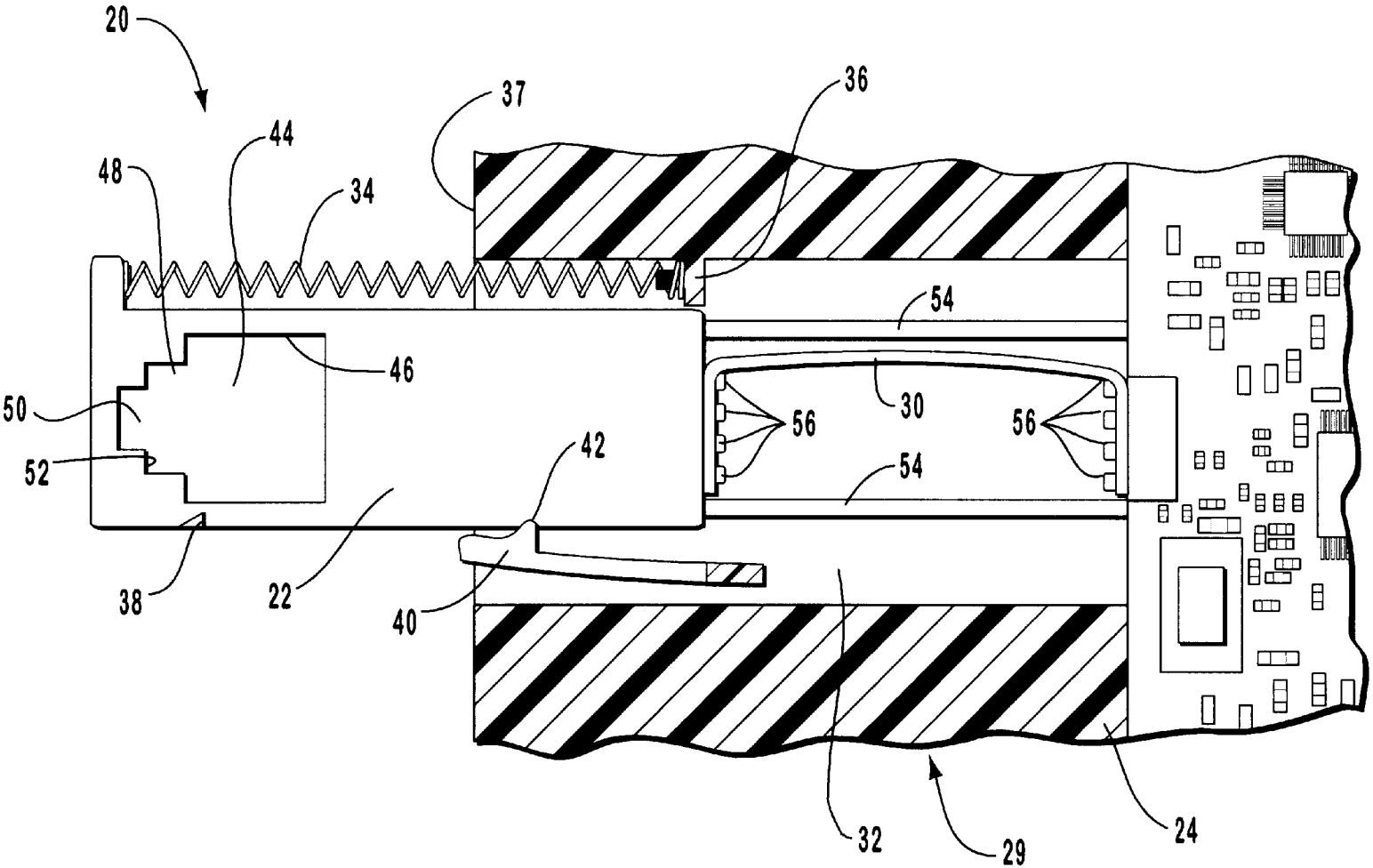
FIG. 1 (PRIOR ART)
FIG. 1 is a plan view of a prior art sliding interface device for interconnecting a media connector with a communications card.
Figure 2:
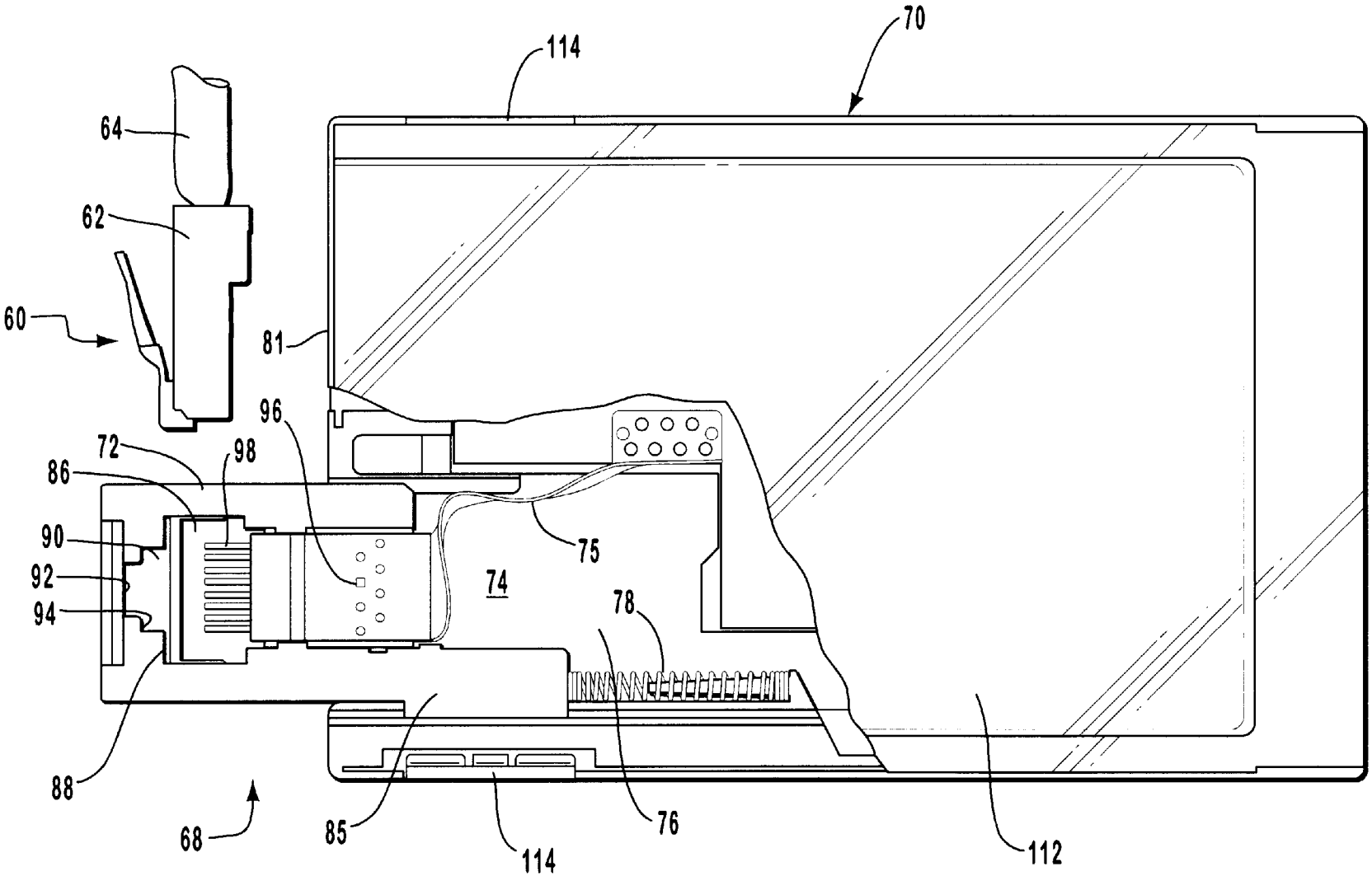
FIG. 2 is a plan view of a communications card, in accordance with the present invention, for electrically connecting a media connector with the communications card and for operably discerning and configuring the communications card to compatibly interact with the media connector.

With reference to FIG. 2, a sliding interface electrical connector in accordance with the present invention for ultimately providing electrical communication between a media connector 60 and a computer (not shown) is depicted generally as 68. Media connector 60 includes electrical terminals for electrically coupling with the conductors of cable 64. Media connector 60, in the preferred embodiment, is compliant with several standards including PC Card 97 Cardbus requirements.

The electrical connector 68 is defined by a communications card 70 having a retractable access portion 72 and a fixed portion 74. The fixed portion 74 is in electrical communication with the computer by means of electronic circuitry connected on a printed circuit board (PCB) housed internally within the communications card 70. As used herein, fixed portion 74 shall refer to the generally stationary features internal to the communications card. Such features include, but are not limited to, the PCB, the electronic circuitry thereon, the mechanical spacers and connectors used to physically connect the PCB to the communications card. The electronic circuitry of the fixed portion further includes sensing circuitry for determining and compatibly configuring the interface for operating with the media connector as well as communications card digital processing circuitry including host interface circuitry. The retractable access portion 72 is in electrical communication with fixed portion 74 through a flexible printed circuit board 75.

During use, in means well known in the art, the retractable access portion 72 slides in and out of a slot 76 formed within the fixed portion 74. The retractable portion 72 is urged out of the slot 76 by a spring 78 biased, in a direction external to the computer housing. Although not shown, the computer housing during use is substantially parallel to an edge 81 of the communications card 70. A limiting notch engaged by a biased lever in assembly 85 is used to restrict the travel distance of the retractable access portion 72 to a predetermined distance when the retractable access portion is urged in a direction external to the computer housing by the spring 78. After use, a retention notch also within assembly in combination with the biased lever is used to retain the retractable access portion 72 within the housing of the computer and the housing of the communications card.

An aperture 86 having a plurality of walls 88 is formed within the retractable access portion 72. The aperture 86 is so sized and shaped as to be capable of receiving a media connector. Formed within aperture 86 by means of walls 88 is a broad retention clip groove 90, a narrow retention clip groove 92, and a retention ridge 94. These structures within aperture 86 provide for the retention of a connector pin block of a media connector. When a user desires to connect a media connector such as a network connector (e.g., RJ-45) or telephone line connector (e.g., RJ-11) to the communications card, the biased lever is manipulated out of the retention notch. As retractable access portion 72 is released from the grip of the biased lever, tension applied by spring 78 urges retractable access portion 72 out of slot 76. The progress of retractable access portion 72 is guided by portions of the sliding interface and is halted when the biased lever engages the limiting notch within assembly 85. A user then inserts at least a portion of media connector 60 into aperture 86 to provide an electrical connection between communications card 70 and the network or other line. When a user no longer desires to access the retractable access portion 72, the user merely presses retractable access portion 72 back within the confines of the computer housing until the retention notch is engaged by the biased lever.

However, it should be appreciated that even further biasing means, aperture embodiments for accepting a media connector during use and retention means for stabilizing the media connector, for example, are contemplated within the scope of the present invention and are more fully described in U.S. Pat. Nos., 5,183,404, 5,336,099 and 5, 338,210. All three of these patents are expressly incorporated herein by reference.

The electrical connector 68 comprises a pin block 96 for accommodating at least one conductive terminal or lead such as electrical contact 98. In FIG. 2, eight conductive leads being in substantially parallel arrangement are illustrated. The conductive lead is preferably one singular conductive material that extends through pin block 96. Preferably, the conductive lead is inserted within and molded contiguously with the pin block 96 in a well known manufacturing technique often referred to as "insert molding."

The first end of the conductive lead 98 is for making electrical contact with the media connector during use when the media connector is inserted into aperture 86. Preferably, the first end extends at least partially into the aperture 86 for electrically contacting the necessary conductors of the media connector. The second end of the conductive lead 98 is interfacing with flexible printed circuit board 75 or other conductors for making electrical contact with the fixed portion 74.

Figure 3:
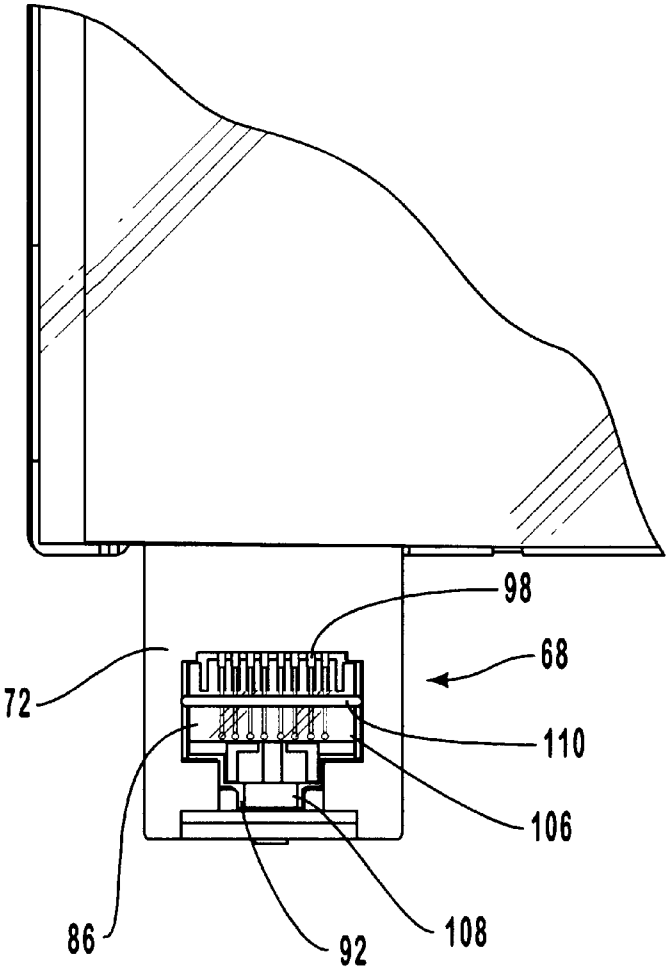
FIG. 3 is a detailed view of an RJ-45 media connector received into the retractable portion of the communications card.

In the preferred embodiment, aperture 86 is compatible for receiving both the RJ-11 and RJ-45 therein. FIG. 3 depicts a bottom view of electrical connector 68 with a received RJ-45 media connector 106, of which a portion is received into aperture 86 of electrical connector 68. As the RJ-45 media connector 106 is received within aperture 86, conductive contact occurs between the terminal contacts of the RJ-45 media connector 106 and the electrical contacts such as the conductive leads 98. To retain positive contact between conductive leads 98 and the electrical contacts of the RJ-45 media connector, a retention clip 108 is tactilely received and retained within a retention clip groove 92. A U-shaped stirrup 110 is pivotally mounted so as to traverse aperture 86 and prove a stop for terminating the insertion of the media connector at a predetermined depth.

Figure 4:
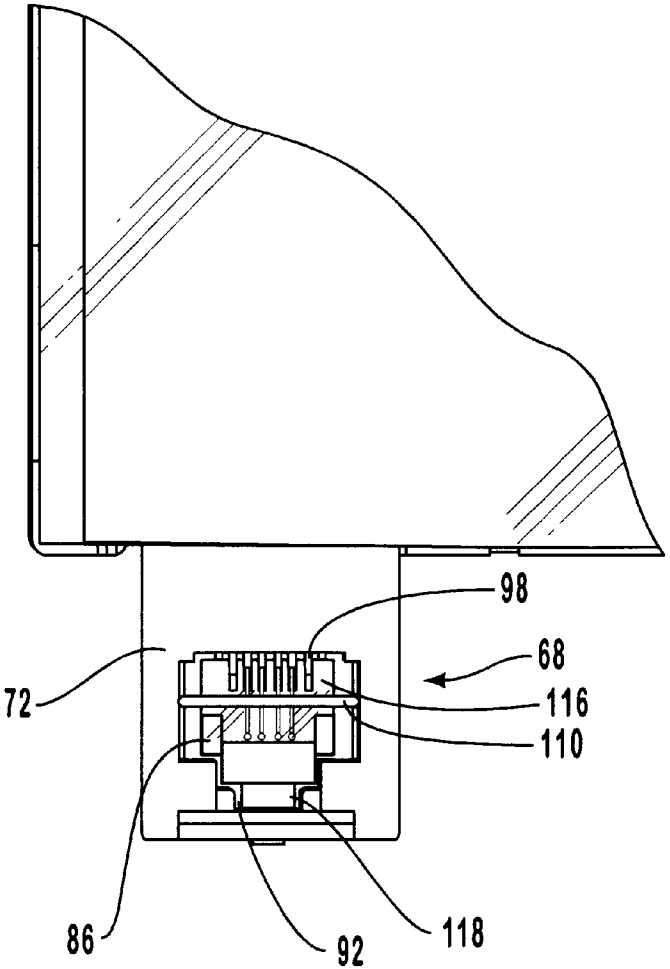
FIG. 4 is a detailed view of an RJ-11 media connector received into the retractable portion of the communications card.

FIG. 4 depicts a bottom view of electrical connector 68 with a media connector having a form-factor of an RJ-11 plug, a portion of which is inserted into aperature 86. It should be pointed out that aperture 86 is additionally compatible for physically hosting both an RJ-11 media connector and an RJ-45 media connector. In the present figure, the RJ-11 media connector 116 is received within aperture 86 upon which conductive contact occurs between the terminal contacts of the RJ-11 media connector 116 and the electrical contacts such as the conductive leads 98. As described above in FIG. 3, a retention clip such at retention clip 118 is tactilely received and retained within a retention clip groove 92 with stirrup 110 proving a stop against which media connector 116 motionally terminates. As mentioned above, the present invention is compatible for both an RJ-11 media connector and an RJ-45 media connector. Since the RJ-45 media connector requires 8 conductive leads 98, electrical connector 68 is fully populated with 8 conductive leads 98. Those skilled in the art appreciate that the RJ-11 media connector 116 is a 4-conductor physical standard. In the present figure, the RJ-11 media connector 116 is centrally received within aperture 86. Therefore, the two end conductive leads 98 remain as no-connects when an RJ-11 media connector 116 is employed in conjunction with the present invention.

Figure 5:
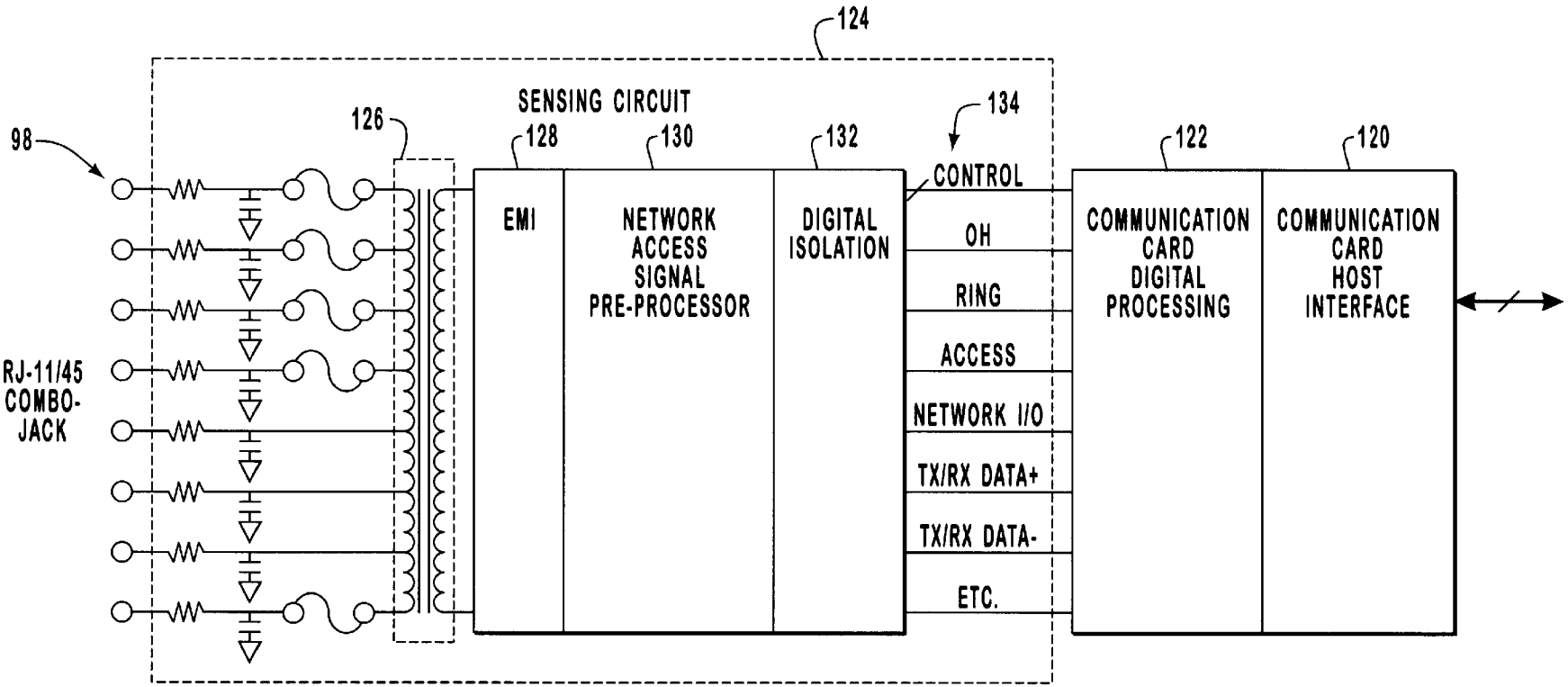
FIG. 5 is block diagram of a sensing circuit for determining the type of interface presented by the media connector to the communications card and for compatibly configuring the communications card to operably interact with the system represented by the media connector, in accordance with a preferred embodiment of the present invention.

FIG. 5 is a block diagram of the electronic circuitry located within the communications card, in accordance with the preferred embodiment of the present invention. As described above, the communications card interfaces with a host computer. To facilitate this interface, the communications card incorporates a communications card host interface 120 providing the requisite interface with the host computer. In the preferred embodiment, the interface takes the form of a PCMCIA interface which communicates via the host bus with the host computer.

Additionally, the communications card provides processing capabilities. Those skilled in the art appreciate that such processing may take the form of traditional modem and network functionality. In the preferred embodiment, a communication card digital processing portion 122 provides the traditional digital processing functionality such as digital signal processing including modulation and other control functions typical of communications cards including ISDN, local area network (LAN) operations such as those characteristic of Ethernet, as well as wireless transceiver control and processing functionality.

TABLE 1

Typical Media Types and Corresponding Pinouts.

| | Media Type | | | | |
|---|---|---|---|---|---|
| PIN | LAN ADAPTER | LAN HUB | ISDN | PSTN | WIRELESS PHONE |
| 1 | TD+ | RD+ | T3 | | X |
| 2 | TD− | RD− | R3 | | X |
| 3 | RD+ | TD+ | T2 | T2 | X |
| 4 | | | R1 | R1 | X |
| 5 | | | T1 | T1 | X |
| 6 | RD− | TD− | R2 | R2 | X |
| 7 | | | T4 | | X |
| 8 | | | R4 | | X |

As described above, in order to operably accommodate both an RJ-11 media connector and an RJ-45 media connector, a total number of 8 separate electrical contacts 98 are employed. Table 1 depicts the typical pinouts required for several interface standards that may be employed by the present invention. The communications card of the present invention may be implemented as both a LAN (e.g., Ethernet) adapter or hub with the pinouts as described in Table 1. In the present embodiment, the electrical contacts that support Ethernet are additionally fused for added circuit protection. For implementation of the ISDN interface standard, Table 1 depicts the use of all 8 electrical contacts 98. Those skilled in the art appreciate that ISDN may be implemented over a 2 wire interface (i.e., generally through the use of pins 4 and 5) as well and is considered within the scope of the present invention. The wireless phone interface of the present invention may utilize all 8 of the electrical contacts 98, however, many wireless interfaces utilize only a portion of the pins of electrical contacts 98.

The present invention includes a sensing circuit 124 within the communications card. Electrical contacts 98 electrically couple with sensing circuit 124 preferably via matching components for each line such as shunt capacitors and series resistors. Additionally, some electrical contacts, preferably lines 1–4 and 8 of electrical contacts 98 as shown, are also fused for additional circuitry protection.

Electrical contacts 98 additionally couple with an analog isolation device 126. Analog isolation device 126 provides isolation characteristic of devices, such as a DAA, that isolate the analog circuitry from the digital processing electronics. Such analog isolation provides physical protection from transient voltage spikes, such as lightning strikes or other power surges, that may be present on the media connector. Analog isolation is mandated in commercial products by safety organizations. Analog isolation may take the form of several techniques such as magnetic coupling/isolation in addition to optical isolation as well.

Following signal conditioning by analog isolation 128, the electrical signals of the media connector optionally pass through Electromagnetic Interference (EMI) process 128 which is operably and electrically coupled to analog isolation 126. EMI process 128 filters stray and undesired transient electrical waveforms that are unrelated to the data passing through the signals presented by the media connector.

The signals next pass through a network access signal pre-processor 130 which is operably and electrically coupled with EMI process 128 and analog isolation 126. Network access signal pre-processor 130 is comprised of logic either hardware alone or hardware and software for evaluating the signals present on each of the signal lines presented to pre-processor 130. Since the standards supported by the present invention facilitate varying signal parameters, the preferred embodiment of pre-processor 130 assumes a VLSI technology that supports an analog/digital hybrid. Pre-processor 130 is further comprised of both analog switches for routing transmit and receive signal lines as well as an embedded processor for both discerning a type of media from the signals presented and then configuring pre-processor 130 for compatible interaction by adapting the interface to the physical layer and other lower protocol layers of the presented media type. Therefore, pre-processor 130 performs the fundamental functions of detecting which type of media is presented to the communications card, compensating the analog electronics to adapt to that detected media type and then pre-processing the data passing therethrough.

Pre-processor 130 operably and electrically couples with a digital isolation process 132. Digital isolation 132 provides a barrier between analog data and the digital world within the communications card. Digital isolation 132 transforms any remaining analog-like information into purely digital form for processing by digital processing portion 122. Digital isolation 132 may optionally be implemented as part of pre-processor 130 as a means of presenting a concise digital interface with digital processor 122. Digital isolation 132, in the preferred embodiment, presents and receives status and control signals 134 with digital processor 122. Typical signals include control signals, off-hook (OH) indicator, ring and access indicators, network I/O, transmit and receive differential signals, cellular cable ID, media ID, 10-Base T/100-Base T indicator, ISDN rate as well as other status and control signals.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A communication card for interfacing a computer with any one of a plurality of different types of communications networks that are operably supported by said communication card, said communication card comprising:

(a) an aperture configured to physically receive at least a portion of a media connector having at least one lead that receives network signals from a communications network selected from one of said plurality of network types, said aperture having at least one electrical contact therein for operably and electrically coupling with the at least one lead; and (b) a fixed portion comprising a sensing circuit configured to receive at least a portion of the network signals and thereby automatically identify which one of said plurality of network types is connected via the media connector and thereby configure said communication card to permit the computer to operably interact with said identified communications network.

2. The communication card as recited in claim 1, wherein said aperture comprises an aperture compatible for receiving said media connector having a form-factor of one of an RJ-11 plug and an RJ-45 plug.

3. The communication card as recited in claim 1, wherein the plurality of communications networks includes at least two networks selected from a wireless network, an Ethernet network, a Public Switched Telephone Network (PSTN) and a Integrated Services Digital Network (ISDN).

4. The communication card as recited in claim 1 wherein the aperture is positioned within a retractable access portion of the communication card.

5. The communication card as recited in claim 1, wherein said sensing circuit comprises a network access signal pre-processor capable of identifying which one of the plurality of network types is supplying the network signals via the at least one lead of the media connector based upon at least one electrical characteristic of the network signals.

6. The communication card as recited in claim 5, wherein said sensing circuit is further comprised of analog isolation and electromagnetic interference (EMI) isolation circuitry, said analog isolation circuitry being operably and electrically coupled to electrically isolate the sensing circuit from the identified communications network and said electromagnetic interference circuitry being electrically and operably coupled to filter electrical noise from data signals present within the network signals received via the at least one lead of the media connector.

7. The communication card as recited in claim 6, wherein said sensing circuit further comprises digital isolation circuitry configured to convert at least a portion of the network signals from an analog form into a digital form.

8. In a communications card having a retractable connecting mechanism with an aperture formed therein configured to receive at least a portion of a media connector with electrical contacts also therein for use in interfacing between said media connector having an interface standard from among a plurality of media standards operably supported by said communication card, a sensing circuit to both determine which one of said plurality of media standards supported by said communication card corresponds with said media connector and operably configure said communication card to compatibly interact with said media connector using a compatible one of said plurality of media standards, said sensing circuitry comprising a network access signal pre-processor for both determining which one of said plurality of media supported by said communications card is presented to said communications card from among a plurality of media operably supported by said communications card and for operably configuring said communications card to compatibly interact with said media connector; and analog isolation and electromagnetic interference (EMI) isolation circuitry, said analog isolation circuitry being operably and electrically coupled between said electrical contacts interfacing with said media connector and said electromagnetic interference circuitry which is electrically and operably coupled with said network access signal pre-processor for electrically isolating said media connector from said network access signal pre-processor.

9. In a communications card having a retractable connecting mechanism, said sensing circuit as recited in claim 8, wherein said sensing circuit is further comprised of digital isolation circuitry.

10. In a communications card having a retractable connecting mechanism, said sensing circuit as recited in claim 8, wherein said sensing circuit is closed within said communications card assuming a PCMCIA form factor for compatible integration with said computer.

11. In a communications card having a retractable connecting mechanism, said sensing circuit as recited in claim 8, wherein said sensing circuit interfaces with said media connector having a form-factor of one of an RJ-11 plug and an RJ-45 plug.

12. A communications connection system for interfacing a computer with any one of a plurality of different types of communications networks that each operate in accordance with different predefined communication protocols, said connection system comprising:

a. a communications card slot formed in a housing of said computer;

b. a communications card capable of being received into said communications card slot of said housing and said communications card operably supporting said plurality of predefined communication protocols, said communications card being comprised of:

i. a retractable access portion having an aperture formed therein configured to electrically and physically receive at least a portion of a media connector that is electrically connected to a communications network selected from one of the plurality of communications networks, said aperture having electrical contacts therein for operably and electrically coupling with said media connector so as to receive network signals from the connected communications network; and ii. a fixed portion being electrically connected with the electrical contacts of said retractable portion and with said computer during use, said fixed portion further comprising a sensing circuit configured to automatically identify which one of said plurality of network types is connected to the media connector based upon at least one electrical characteristic of the network signals and thereby configure said communication card to permit the computer to operably interact with said connected communications network.

13. The communications connection system as recited in claim 12, wherein said aperture of said retractable access portion of said communication card comprises an aperture compatible for receiving said media connector having a form-factor of one of an RJ-11 plug and an RJ-45 plug.

14. The communications connection system as recited in claim 12, wherein the plurality of communications networks includes at least two networks selected from a wireless network, an Ethernet network, a Public Switched Telephone Network (PSTN) and a Integrated Services Digital Network (ISDN).

* * * * *

UNITED STATES PATENT AND TRADEMARK OFFICE

CERTIFICATE OF CORRECTION

PATENT NO. : 6,059,583
DATED : May 9, 2000
INVENTOR(S) : Kenneth A. Croft, Stephen J. Parker It is certified that error appears in the above-identified patent and that said Letters Patent is hereby corrected as shown below:

Column 6,
Line 40, please change "card," to -- card. --

Column 7,
Line 44, please change "F.C.C. parts 15(bold) and 68(bold)" to -- F.C.C. parts 15 (unbold) and 68(unbold) --
Line 59, please change "PC Card 97(bold)" to -- PC Card 97 (unbold) --

Column 8,
Line 55, please change "5, 338,210" to -- 5,338,210 --

Column 9,
Line 22, change "stirrup 110(unbold)" to -- stirrup 110(bold) --
Line 44, please change "4(bold)-conductor" to -- 4(unbold)-conductor --

Column 10,
Line 34, please change "a 2(bold) wire" to -- a 2(unbold) wire --
Line 58, please change "isolation 128," to -- isolation 126, --

Column 11,
Line 35, please change "10(bold)-Base" to -- 10(unbold)-Base --; and please change "100(bold)-Base" to -- 100(unbold)-Base --

Column 12,
Line 62, please change "closed" to -- enclosed --

Signed and Sealed this

Thirteenth Day of November, 2001

*Attest:*

Nicholas P. Godici

*Attesting Officer*

NICHOLAS P. GODICI
*Acting Director of the United States Patent and Trademark Office*